US012653255B2

(12) United States Patent
Boddaert et al.

(10) Patent No.: US 12,653,255 B2
(45) Date of Patent: Jun. 16, 2026

(54) SET COMPRISING A CARRYING ARTICLE AND AN ACCESSORY DESIGNED TO BE STORED IN A POCKET OF SAID ARTICLE

(71) Applicant: DECATHLON, Villeneuve d'Ascq (FR)

(72) Inventors: Lucie Boddaert, Villeneuve d'Ascq (FR); Nicolas Lenglet, Villeneuve d'Ascq (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 18/531,943

(22) Filed: Dec. 7, 2023

(65) Prior Publication Data

US 2024/0188661 A1 Jun. 13, 2024

(30) Foreign Application Priority Data

Dec. 8, 2022 (FR) ..... 2213020

(51) Int. Cl.
*A41D 27/20* (2006.01)
*A41D 1/04* (2006.01)

(52) U.S. Cl.
CPC ..... *A41D 27/207* (2013.01); *A41D 1/04* (2013.01); *A41D 27/205* (2013.01)

(58) Field of Classification Search
CPC ..... A41D 1/04; A41D 13/0012; A41D 27/20; A41D 27/201; A41D 27/205; A41D 27/207; A41D 2300/332; A45C 13/1038; A45C 13/1046; A45C 13/1053; A45C 2013/1061; A45C 13/30; A45C 2013/303; A45C 2013/306; A45C 2200/20; A45F 3/04; A45F 3/166; A45F 5/02; A45F 5/022; A45F 5/1583; A45F 5/1588; A45F 2005/006; A45F 2005/008
See application file for complete search history.

(56) References Cited

U.S. PATENT DOCUMENTS 4,979,833 A * 12/1990 Cook ..... A45C 3/00 383/117
4,993,128 A * 2/1991 Gold ..... F16G 11/02 24/712
5,150,970 A * 9/1992 Albarelli ..... B65D 29/04 383/117

(Continued)

FOREIGN PATENT DOCUMENTS

FR 2797753 A1 * 3/2001 ..... A45C 13/1046
WO WO-0132522 A1 * 5/2001 ..... A45C 13/06

*Primary Examiner* — F Griffin Hall
(74) *Attorney, Agent, or Firm* — MARSHALL, GERSTEIN & BORUN LLP

(57) ABSTRACT

A set including a carrying article presenting a carrying pocket having an access opening, an accessory intended to be stored in said pocket presenting a free part disposed in the access opening, the access opening being equipped with a duct in which is disposed an elastic cord for retraction of the opening onto the free part, the cord having at least one strand arranged outside the duct to enable the opening to be retracted by pulling on the strand in a tightening configuration, the strand having no device for maintaining its tension outside the duct in the tightening configuration, the strand being arranged to enable it to be maintained in the tightening configuration by cooperation with the free part.

11 Claims, 4 Drawing Sheets

(56) References Cited

U.S. PATENT DOCUMENTS 5,158,220 A * 10/1992 Glass ..... A45C 3/12 224/656
D335,957 S * 6/1993 Cantrell ..... D3/229
5,458,278 A * 10/1995 LaConte ..... A45F 3/04 224/652
6,135,333 A * 10/2000 Tucker ..... A01M 31/00 224/931
6,247,260 B1 * 6/2001 Kandlbinder ..... A01K 83/06 43/44.4
6,364,187 B1 * 4/2002 Castellano ..... A45F 5/02 224/675
6,401,993 B1 * 6/2002 Andrino ..... A45F 5/00 D3/229
7,252,213 B1 * 8/2007 DeSanto ..... B65D 81/3886 224/148.7
7,971,764 B2 * 7/2011 Sabbah ..... A45F 5/00 224/652
8,814,016 B2 * 8/2014 Murdoch ..... A45F 3/005 224/648
9,775,428 B2 * 10/2017 Johnson ..... A45F 5/00
10,869,539 B2 * 12/2020 Caldwell ..... H04B 1/385
11,109,663 B2 * 9/2021 Hoge ..... A01M 31/006
11,533,984 B2 * 12/2022 Duncan ..... A45C 3/001
11,758,999 B1 * 9/2023 Hetzel ..... A45F 3/047 224/631
11,950,686 B2 * 4/2024 Irons ..... A41D 3/005
12,137,783 B2 * 11/2024 Aquino ..... A45F 3/04
2006/0037982 A1 * 2/2006 Lesser ..... A45F 5/021 224/148.7
2012/0160884 A1 * 6/2012 Levine ..... A45C 13/08 224/148.5
2020/0237082 A1 * 7/2020 Willows ..... A45F 5/10
2020/0305581 A1 * 10/2020 Barklow ..... A41D 13/0007
2021/0068511 A1 * 3/2021 Caldwell ..... A45C 7/0072
2021/0130040 A1 * 5/2021 Sanders ..... D04B 21/20
2022/0265032 A1 * 8/2022 Datcher ..... A61L 2/18
2022/0287388 A1 * 9/2022 Thatcher ..... A41D 1/04
2024/0023654 A1 * 1/2024 Schneider ..... A41D 1/04
2024/0237792 A1 * 7/2024 Chao ..... A45C 11/00

* cited by examiner

SET COMPRISING A CARRYING ARTICLE AND AN ACCESSORY DESIGNED TO BE STORED IN A POCKET OF SAID ARTICLE

CROSS-REFERENCE TO RELATED APPLICATION

The present application claims priority to French Application No. FR-22 13020, filed on Dec. 8, 2022. The priority application, FR-22 13020, is hereby incorporated by reference.

FIELD OF THE DISCLOSURE

The invention concerns a set comprising a carrying article and an accessory designed to be stored in a pocket of said article.

BACKGROUND

It applies in particular to a set comprising a carrying article whose structure forms a vest comprising a back and shoulder straps designed to cover respectively the back and each of the shoulders of a user, especially during the practice of an outdoor sporting activity such as running in an urban environment or in a natural environment (trail), hiking, or Nordic walking.

Such items include carrying pockets to enable the user to carry accessories needed for practicing his activity, such as his phone, beverage dispensing containers such as a gourd, soft flask or water pouch, or nutrition products such as energy bars or gel or compote flasks.

In particular, sets are known, comprising:

- a carrying article whose covering structure has a pocket which comprises a yoke fixed to the periphery of a zone of said structure, for example on the front of a shoulder strap of a vest, while having an opening for access to said pocket;
- an accessory comprising a beverage dispensing container designed to be stored in the pocket, said container having an upper neck forming a free part disposed in said access opening, said neck being notably equipped with a dispensing device, for example comprising a teat.

To ensure that the accessory remains in the pocket, it is known to equip the access opening with a duct in which an elastic cord is arranged to retract said opening onto the free part.

In particular, the cord has at least one strand arranged outside the duct to enable the opening to be retracted by pulling said strand in a tightening configuration, said strand being equipped with a device for maintaining its tension outside the duct in the tightening configuration, said device comprising, for example, a "tanka"-type organ for blocking the sliding of said strand.

SUMMARY OF THE DISCLOSURE

This solution is not entirely satisfactory, in that reliable tightening requires manipulation of the organ, which is impractical during sporting activities, especially when using both hands.

The invention aims to improve the prior art by proposing, in particular, a set comprising a carrying article equipped with a pocket which is arranged to hold the accessory intended to be stored therein in a simple and reliable manner, with facilitated gestures, in particular with a single hand, to enable the user to store or extract said accessory from said pocket during the practice of his sporting activity.

For this purpose, the invention proposes a set comprising a carrying article which has a structure designed to cover a part of a body of a user, said structure having a carrying pocket comprising a yoke fixed to the periphery of a zone of the structure while having an access opening to said pocket, said set further comprising an accessory intended to be stored in said pocket and having a free part disposed in said access opening, said access opening being equipped with a duct in which is arranged an elastic cord for retracting said opening onto said free part, said cord having two ends associated with the structure and at least one strand arranged on the outside of the duct to enable the opening to be retracted by pulling on said strand in a tightening configuration, the strand having no device for maintaining its tension outside the duct in the tightening configuration, said strand being arranged to enable it to be maintained in the ti configuration by cooperation with the free part.

BRIEF DESCRIPTION OF THE SEVERAL VIEWS OF THE DRAWING

Further features and advantages of the invention will become apparent from the following description, made with reference to the appended figures, in which.

DETAILED DESCRIPTION OF THE PREFERRED EMBODIMENTS

Figure 1A:
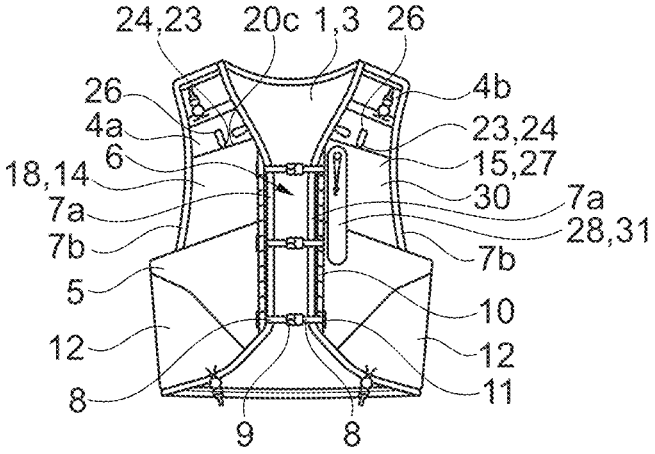
FIG. 1*a* shows, schematically, a carrying article according to one embodiment of the invention, in front view.

In relation to these figures, we describe below a carrying article which has a structure 1 designed to cover a part of the body of a user 2.

In the description, the terms positioning in space are taken to refer to the carrying article as shown in the figures, as well as to the position of the user 2 when wearing said article. In particular:

- the terms "left" and "right" are taken to refer to the laterality of the user 2 wearing the article;
- the terms "inner" and "outer" are taken with reference to a sagittal anatomical plane of the body of the user 2, and designate positions respectively close to and distant from this sagittal plane;
- the terms "inside" and "outside" refer to the position of the carrying article in relation to the part of the body of the user 2 that it covers, and designate positions respectively close to and far from the said part of the body.

In the embodiments shown, the carrying article is a vest designed to be worn during an outdoor sporting activity, such as running in an urban environment or trail running in a natural environment, hiking or Nordic walking. Alternatively, the carrying article can take other forms, such as a belt designed to be worn around the waist of the user 2, for a use similar to that of the vest.

The structure 1 of the vest shown comprises a back 3 and shoulder straps 4*a*, 4*b* designed to cover the back and shoulders of the user 2 respectively. In particular, the vest comprises a lower sleeve 5 of a height adapted to surround the abdominal belt of the user 2, said sleeve laterally connecting the lower end of each shoulder strap 4*a*, 4*b* with the adjacent side of the back 3.

The vest comprises a front slit 6 that extends between respective inner lateral edges 7*a* of the shoulder straps 4*a*, 4*b* and of the lower sleeve 5, so as to enable the user 2 to put on the article by spreading said slit.

Figure 1B:
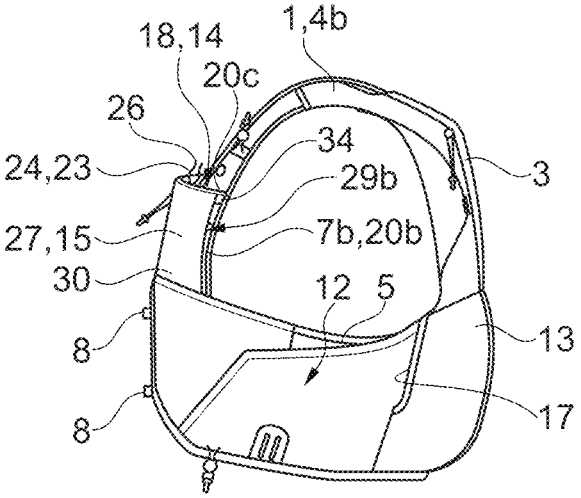
FIG. 1*b* shows, schematically, a carrying article according to one embodiment of the invention, in side view.
Figure 2A:
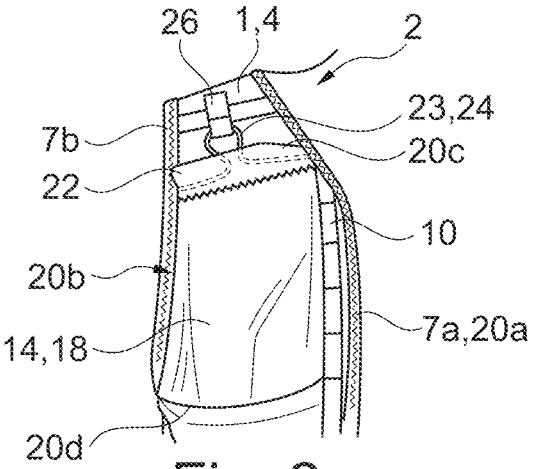
FIG. 2*a* shows partially, from a front view, the pocket on the right shoulder strap of the carrying article shown in FIGS. 1*a* and 1*b;*
Figure 2B:
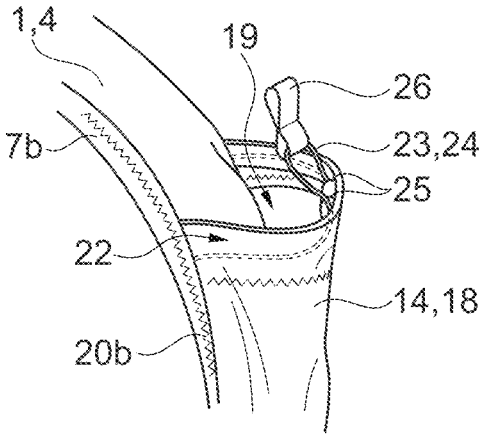
FIG. 2*b* shows partially, from a side view, the pocket on the right shoulder strap of the carrying article shown in FIGS. 1*a* and 1*b;*
Figure 3A:
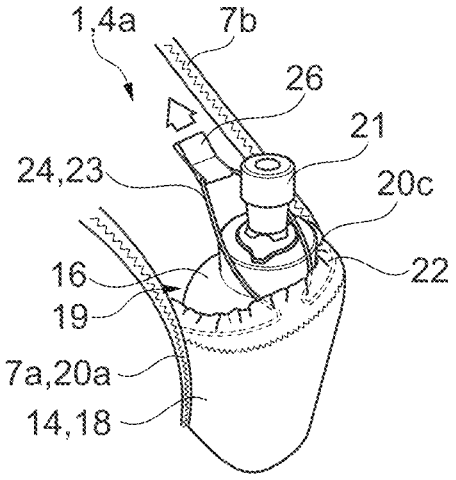
FIG. 3*a* shows a first perspective view of the pocket shown in FIGS. 2*a* and 2*b* during a first stage of tightening of the cord around the free part of the accessory stored in the pocket.
Figure 3B:
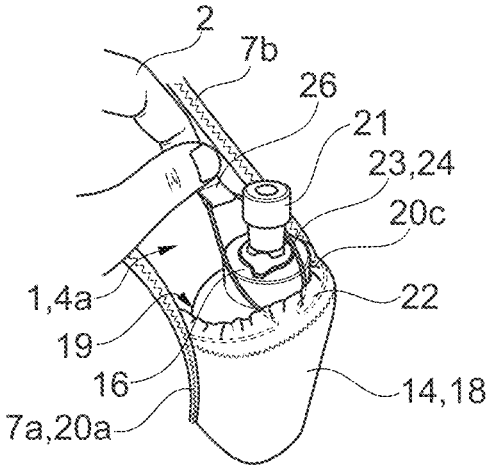
FIG. 3*b* shows a second perspective view of the pocket shown in FIGS. 2*a* and 2*b* during a second stage of tightening of the cord around the free part of the accessory stored in the pocket.
Figure 3C:
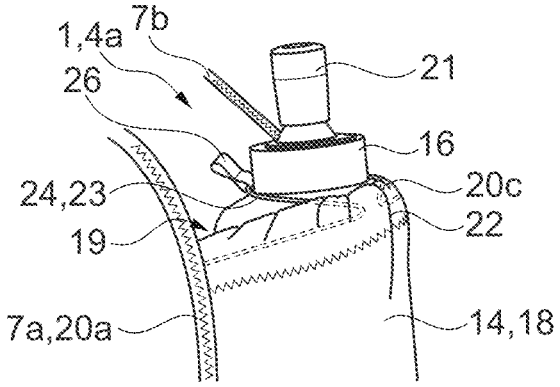
FIG. 3*c* shows a third perspective view of the pocket shown in FIGS. 2*a* and 2*b* during a third stage of tightening the cord around the free part of the accessory stored in the pocket.

In FIGS. 1*a* and 1*b*, the vest presents three pairs of straps 8, each arranged respectively on an inner edge 7*a* of the sleeve 5 or of the adjacent shoulder strap 4*a*, 4*b*, and provided with complementary reversible fastening means 9 to hold the article in place on the torso of the user 2.

In particular, each edge 7*a* of the slit 6 comprises notches 10 evenly distributed over part of its height, each strap 8 comprising an anchoring means 11 formed on its end opposite to that carrying the means 9 for fastening to the other strap 8, said anchoring means being arranged to be reversibly and selectively fixed in one of said notches, to enable the user 2 to adjust the height of the straps 8 to his morphology.

Advantageously, the vest is made from a mesh-type textile material, to improve comfort for the user 2 during sporting activity, notably by allowing air to circulate and perspiration to evacuate.

The article includes carrying pockets 12, 13, 14, 15 to enable the user 2 to carry accessories 16 necessary for the practice of his sporting activity, such as, for example, his telephone, beverage dispensing containers such as a gourd, soft flask or water pouch, or nutritional products such as energy bars or flasks of gel or compote.

In FIGS. 1*a* and 1*b*, the article comprises two lower side pockets 12 each formed on a respective portion of the sleeve 5, to enable storage of accessories such as nutrition products, each lower pocket 12 comprising an access opening equipped with reversible closure means, for example in the form of hook-and-loop fastening bands, to prevent the accessories stored therein from falling out when the user 2 is moving about.

The article also comprises a rear pocket 13 formed on the back 3, and accessible via a lateral opening 17 to enable storage therein of a clothing accessory such as a rain jacket, the lateral position of said opening allowing access to said rear pocket when the article is worn by the user 2, notably when practicing a sporting activity. In particular, this opening 17 is equipped with an elastic band, in order to keep the accessory stowed away in the rear pocket 13, and thus avoid dropping and losing said accessory through said opening.

The back 3 of the vest can also be fitted with a back pocket designed for carrying a large beverage dispensing container, for example a water pouch fitted with a hose for dispensing said beverage provided with a teat at its free end, said back pocket and the vest being designed to allow the teat to be positioned close to the head of the user 2, for example on one of the shoulder straps 4*a*, 4*b*, so as to give said user easy access to said teat when he wishes to consume the drink contained in said water pouch, particularly during his sporting activity.

In particular, the structure 1 presents a carrying pocket 14 which comprises a yoke 18 fixed to the periphery of a zone of said structure, while presenting an opening 19 for access to said pocket.

In the embodiments shown, the zone equipped with the pocket 14 is formed on one of the shoulder straps 4*a*, 4*b*, in particular on the right shoulder strap 4*a*. Advantageously, each of the shoulder straps 4*a*, 4*b* comprises such a pocket 14, in order to provide the user 2 with more places to store his accessories 16, and in particular to adapt the storage of said accessories according to his laterality.

For each shoulder strap 4*a*, 4*b*, the zone equipped with the pocket 14 is designed to cover a lateral portion of the chest of the user 2, to allow said user easy access to the accessory 16 stored in said pocket.

Each shoulder strap 4*a*, 4*b* comprises, in addition to the inner lateral edge 7*a*, an outer lateral edge 7*b* which is spaced from said inner edge along a transverse dimension adapted to form a substantial contact surface between said shoulder strap and the shoulder of the user 2, and thus guarantee the comfort of said user when wearing the article.

In addition, each yoke 18 comprises two lateral edges 20*a*, 20*b*, each of which is associated with a respective lateral edge 7*a*, 7*b* of the corresponding shoulder strap 4*a*, 4*b*. In this way, each pocket 14 extends over the entire transverse dimension of the shoulder strap 4*a*, 4*b*, which allows providing pockets 14 that are suitable for carrying large accessories 16, in particular beverage dispensing containers 16, as shown in FIGS. 3*a* to 3*c* and 4*a*, 4*b*.

In particular, each yoke 18 has a transverse dimension which is greater than the total transverse dimension of the shoulder strap 4*a*, 4*b*, in order to give the pocket 14 a volume and thickness of dimension(s) suitable for accommodating accessories 16 as described above.

In the embodiments shown, each pocket 14 is formed between the yoke 18 and the zone 4*a*, 4*b* of the structure 1, i.e. on the outside face of a shoulder strap 4*a*, 4*b*, the yoke 18 having a dissociated edge 20*c* which forms the access opening 19 of said pocket. To this end, the yoke 18 is attached to the corresponding shoulder strap 4*a*, 4*b* by stitching around its periphery, and in particular has two lateral edges 20*a*, 20*b* and a bottom edge 20*d*, each of which being stitched to respectively a lateral edge 7*a*, 7*b* and the body of said shoulder strap.

The set also includes an accessory 16 designed to be stored in one of the pockets 14, with a free part 21 arranged in the access opening 19 of said pocket.

In the figures, the accessory is a container 16 for dispensing a beverage and has an upper neck 21 forming the free part. In particular, the container 16 is of the soft flask type, and comprises a flexible body, which notably makes it possible to reduce its bulk when it does not contain a beverage, as well as a neck 21 which is equipped with a teat that the user 2 can pinch between his lips to take a quantity of beverage contained in said container.

Advantageously, the access opening 19 of each pocket 14 extends into the upper part of said pocket, enabling the container 16 to be stored vertically in said pocket, with its dispensing neck 21 pointing upwards, and in particular towards the head of the user 2 wearing the article. In this way, the user 2 can easily access the container 16 when he wishes to consume the beverage it contains.

In particular, the dispensing neck 21 can be equipped with a straw-like tubular extension, whose length is sufficiently long to enable the user 2 to consume the beverage contained in the container 16 by sucking with his mouth directly on the upper end of said extension, without having to remove said container from the pocket 14.

The access opening 19 of each pocket 14 is equipped with a duct 22 in which an elastic cord 23 for retracting said opening is arranged, in particular on the free part 21 of an accessory 16 stored in said pocket.

In relation to the figures, each yoke 18 comprises a hem which is fixed by sewing at its dissociated edge 20*c* to form the duct 22, the elastic cord 23 having two ends associated by sewing respectively with a lateral edge 7*a*, 7*b* of the corresponding shoulder strap 4*a*, 4*b*.

The elastic cord 23 further comprises at least one strand 24 arranged outside the duct 22 to enable the opening 19 to be retracted by pulling on said strand in a tightening configuration.

For this purpose, the duct 22 comprises two holes 25 formed on an inside face of the yoke 18, through which a respective portion of the cord 23 passes. In particular, each hole 25 comprises a rigid eyelet, for example made of plastic and/or metal material, to facilitate sliding of the corresponding cord portion 23 into said hole.

As shown in the figures, each strand 24 has no device for maintaining its tension outside the corresponding duct 22 in the tightening configuration, said strand being arranged to be held in the tightening configuration by cooperation with the free part 21 of the accessory 16 stored in the pocket 14.

In particular, the length of the strand 24 allows it to be arranged by extension on the free part 21, the elastic return of the cord 23 on said free part ensuring both that the strand 24 is held in the tightening configuration and that the opening 19 is pressed against said free part.

Advantageously, the strand 24 forms a loop which is arranged to surround the free part 21 in the tightening configuration, which constitutes a simple and intuitive design, and enables the user 2 to quickly and reliably tighten the opening 19 of the pocket 14 around his accessory 16, particularly with just one hand while practicing his sporting activity.

Figure 4:
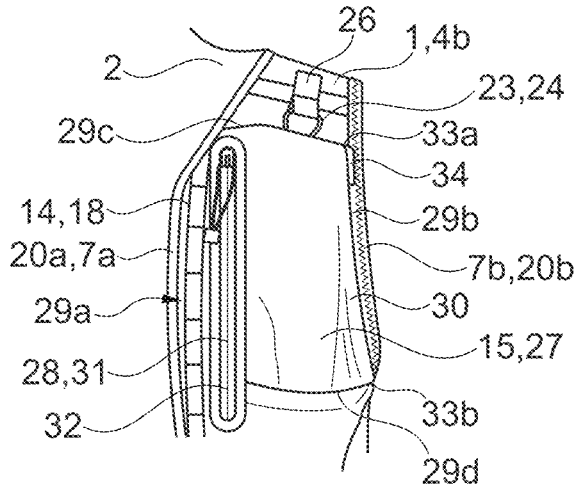
FIG. 4 shows a partial front view of the pockets on the left shoulder strap of the carrying article shown in FIGS. 1*a* and 1*b;*
Figure 4A:
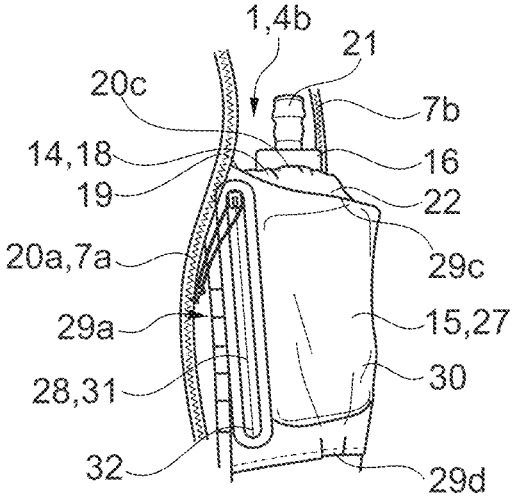
FIG. 4*a* shows a first perspective view of the pockets shown in FIG. 4 with accessories stored in them.
Figure 4B:
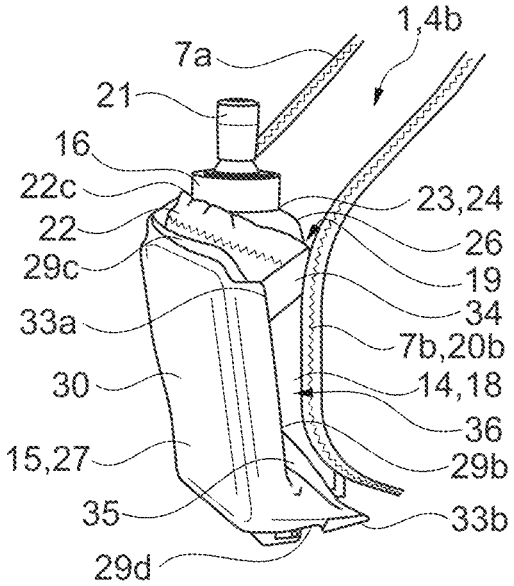
FIG. 4*b* shows a second perspective view of the pockets shown in FIG. 4 with the accessories stored in them.
Figure 5A:
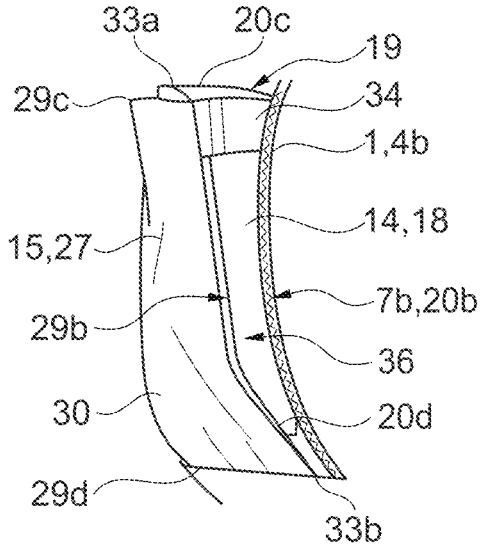
FIG. 5*a* shows the assembly of the pockets shown in FIG. 4, in a first perspective view.
Figure 5B:
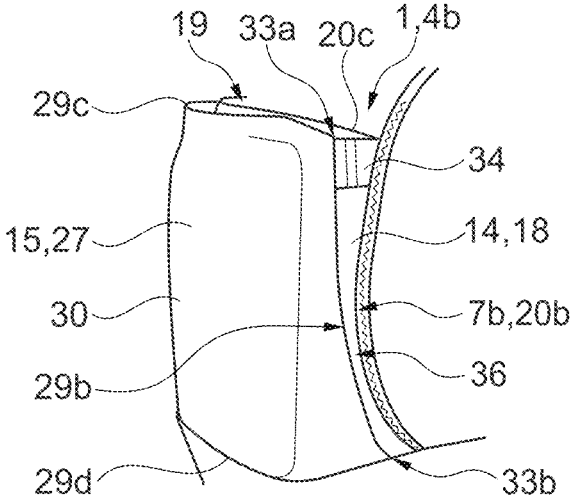
FIG. 5*b* shows the assembly of the pockets shown in FIG. 4, in a second perspective view.

Advantageously, the strand 24 is equipped with a gripping tab 26 to enable the user 2 to arrange the cord 23 in a tightening configuration by manually pulling on said tab, as shown in FIGS. 4*a* and 4*b*. Similarly, when wishing to extract the accessory 16 from the pocket 14, the user 2 can grasp the tab 26 to remove the loop 24 of the cord 23 from the free part 21 of said accessory.

In the figures, and in particular in relation to FIGS. 4, 4*a*, 4*b*, the left shoulder strap 4*b* of the vest comprises a first pocket 14 as described above for carrying a first accessory 16, in particular a beverage-dispensing container of the gourd or soft flask type, as well as a second pocket 15 for carrying a second accessory, in particular a flat, rigid accessory of the mobile terminal or smartphone type.

In variants not shown, the right shoulder strap 4*a* of the vest 1 can also include such a second pocket 15 superimposed on its pocket 14 for carrying a container 16.

The second pocket 15 comprises a sheath 27 which has an opening 28 for access to said second pocket, said sheath being associated with the structure 1 by being arranged above the yoke 18 of the first pocket 14.

In the embodiments shown, the access opening 28 of the second pocket 15 extends in a direction that is perpendicular to the direction of the access opening 19 of the first pocket 14, on which said second pocket is superimposed. In this way, the two openings 19, 28 are spatially dissociated, making it easier for the user 2 to differentiate them.

In particular, the access opening 28 of the second pocket 15 extends vertically along a lateral edge 29*a* of the sheath 27, while the access opening 19 of the first pocket 14 extends horizontally along the upper edge 20*c* of the yoke 18.

Advantageously, the access opening 28 of the second pocket 15 extends vertically along a lateral edge 29*a* of the sheath 27, which is adjacent to the inner lateral edge 7*a* of the shoulder strap 4*b*. In this way, the user 2 can easily access this opening 28 when wearing the article, so as to extract or store a second accessory in the second pocket 15, particularly during the practice of his sporting activity.

In the figures, the sheath 27 comprises an outside wall 30 in which the access opening 28 of the second pocket 15 is formed via a slot 31. The slot 31 has a longitudinal dimension that is large enough to enable the user 2 to store a second accessory of significant length and/or width, such as a telephone or smartphone, in the second pocket 15.

The slot 31 is equipped with reversible closure means, notably in the form of a watertight closure 32, which makes it possible to store a second sensitive accessory, notably an electronic accessory such as a telephone or smartphone, in the second pocket 15, while protecting it from moisture and the risk of it falling out of said second pocket through said slot.

At least one edge 29*b* of the sheath 27 is dissociated from the shoulder strap 4*b* between two ends 33*a*, 33*b* of said edge, one of said ends being associated with said shoulder strap by means of an elastic link 34 allowing said sheath to move away from said yoke 18.

Thus, when a first accessory 16 is stored in the first pocket 14, in particular a bulky accessory such as a flask filled with a beverage, the user 2 can move the second pocket 15 away from said first pocket by pulling the sheath 27 forward, thus maintaining the flatness of said second pocket, and facilitating the storage of a second accessory in said second pocket.

In the embodiments shown, the dissociated edge is a lateral edge 29*b* of the sheath 27, and the access opening 28 to the second pocket 15 is formed along the opposite lateral edge 29*a* of said sheath. Thus, in the figures, the dissociated edge is the outer lateral edge 29*b* of the sheath 27.

Referring to FIG. 4*b*, the sheath 27 comprises an inside wall 35 facing the yoke 18 of the first pocket 14, forming between them a space 36 for elastic clearance between said pockets, which opens out at the dissociated edge 29*b*.

The end 33*a* equipped with the elastic link 34 is adjacent to the upper opening 19 of the first pocket 14. In particular, the upper 29*c* and outer lateral 29*b* edges of the sheath 27 are both dissociated from the shoulder strap 4*b*, and the elastic link 34 is associated with the upper end 33*a* of said outer lateral edge, thus facilitating the separation of the sheath 27 from the first pocket 14.

In addition, the inner lateral edge 29*a* and the lower edge 29*d* of the sheath 27 are both sewn to the shoulder strap 4*b*, so that the other end 33*b* of the dissociated edge 29*b* is fixed to said shoulder strap. This arrangement makes it possible to form a pivot along the lower edge 29*d* of the sheath 27, around which said sheath can pivot when the user 2 elastically moves it away from the first pocket 14 to store a second accessory therein.

In particular, the lower edge 29*d* of the sheath 27 is sewn to the shoulder strap 4*b* by being offset in height below the lower edge 20*d* of the yoke 18, in order to limit interactions between the pockets 14, 15, and in particular between the accessories 16 stored in each of said pockets.

What is claimed is:

1. A set comprising a carrying article which has a structure designed to cover a part of the body of a user, said structure having a carrying pocket comprising a yoke fixed to a periphery of a zone of the structure and having an access opening to the pocket, the access opening formed by a disassociated edge of the yoke, the set further comprising an accessory intended to be stored in the pocket and having a free part arranged in the access opening, the yoke including a hem along the disassociated edge, the access opening being equipped with a duct, formed by the hem along the disassociated edge of the yoke, in which is arranged an elastic cord for retracting the access opening onto the free part of the accessory, the cord having two ends associated with the structure and at least one segment arranged outside the duct to enable the access opening to be retracted by pulling on the at least one segment in a tightening configuration, the at least one segment having no device for maintaining its tension outside the duct in the tightening configuration, the at least one segment being arranged to enable it to be maintained in the tightening configuration by cooperation with the free part.

2. The set according to claim 1, the at least one segment forming a loop which is arranged to surround the free part in the tightening configuration.

3. The set according to claim 1, the duct comprising two orifices through each of which a portion of the cord passes.

4. The set according to claim 3, the orifices being formed on an inside face of the yoke.

5. The set according to claim 1, the access opening of the pocket extending into an upper part of the pocket.

6. The set according to claim 1, the at least one segment being equipped with a gripping tab to enable it to be arranged in a tightening configuration by manual traction on the tab.

7. The set according to claim 1, the accessory being a beverage dispensing container which has an upper neck forming the free part.

8. The set according to claim 1, the structure comprising a second pocket for carrying a second accessory, said second pocket comprising a sheath having an access opening, the sheath being associated with the structure by being arranged above the yoke.

9. The set according to claim 8, at least one edge of the sheath being dissociated from the structure between two ends of the edge, one of the ends being associated with the structure by means of an elastic link allowing the sheath to be moved away from the yoke.

10. The set according to claim 1, the structure forming a vest comprising a back and shoulder straps intended to cover the back and shoulders of the user respectively, the zone equipped with the pocket being formed on one of the shoulder straps.

11. The set according to claim 10, the shoulder strap comprising lateral edges, each of which is associated with a respective lateral edge of the yoke.

* * * * *